US005964621A

United States Patent [19]

Wolla et al.

[11] Patent Number: 5,964,621

[45] Date of Patent: Oct. 12, 1999

[54] CONNECTOR ASSEMBLY FOR MULTI-POCKET HEADER

[75] Inventors: David M. Wolla, Winston-Salem; Donald Robert Worthington, Jr., Pfafftown, both of N.C.

[73] Assignee: The Whitaker Corporation, Wilmington, Del.

[21] Appl. No.: 09/104,544

[22] Filed: Jun. 25, 1998

[51] Int. Cl.[6] ..... H01R 13/73

[52] U.S. Cl. ..... 439/595; 439/744

[58] Field of Search ..... 439/595, 744, 439/67, 752, 597, 598, 352, 745, 354, 350, 357, 358

[56] References Cited

U.S. PATENT DOCUMENTS

| | | | |
|---|---|---|---|
| 5,067,916 | 11/1991 | Denlinger et al. | 439/857 |
| 5,071,369 | 12/1991 | Denlinger et al. | 439/595 |
| 5,100,346 | 3/1992 | McCardell | 439/595 |
| 5,151,045 | 9/1992 | Cravens et al. | 439/271 |
| 5,328,382 | 7/1994 | Pawlicki | 439/595 |
| 5,743,756 | 4/1998 | Hasz et al. | 439/364 |

*Primary Examiner*—Steven L. Stephan
*Assistant Examiner*—Hae Moon Hyeon
*Attorney, Agent, or Firm*—Bradley N. Ditty

[57] ABSTRACT

An electrical connector assembly includes two plug connectors 2 that can be mounted in separate pockets 66 in a pin header 62 that can be mounted on an electronic module. Separate plug connectors 2 can be attached to separate wiring harnesses. To insure that an adequate number of wires can be connected in a header of substantially the same size, terminal latches 18 on inner ends of terminal rows are deflectable in a direction that is perpendicular to the direction in other terminal latches 16 in the same row are deflected when terminals 20 are inserted into the housing 4. A terminal position assurance member 30 includes a cantilevered plate 32 that engages terminal latches 16 and a cantilevered arm 24 that engages the terminal latch 18. This provides space for a force applying bolt 50 to be used in each connector.

20 Claims, 8 Drawing Sheets

CONNECTOR ASSEMBLY FOR MULTI-POCKET HEADER

BACKGROUND OF THE INVENTION

1. Field of the Invention

This invention is related to electrical connector assemblies including pin header connectors and mating plug connectors. More specifically this invention is related to connector assemblies that can be used to connect wiring harnesses to electronic components such as those used in motor vehicles.

2. Description of the Prior Art

U.S. Pat. No. 5,067,916; U.S. Pat. No. 5,071,369; and U.S. Pat. No. 5,151,045 disclose an electrical connector assembly that can be used to connect a wiring harness to an electronic component or module that can be used in applications such as a motor vehicle. That connector assembly includes a right angle pin header including pin terminals that can be soldered to a printed circuit board in the electronic module and a plug connector that is attached to a wiring harness. A gasket seal is used to seal the interface between the two connectors and a wire seal is employed on the rear of the plug connector. Terminals are positioned in the plug connector in four rows. A terminal position assurance member is inserted into the mating face of the plug connector to add support to molded terminal latches that comprise the primary terminal latching members. Stamped and formed terminals have a generally cylindrical cross section with an annular recess that is engaged by a molded terminal latch when the terminals are inserted into respective terminal cavities. If the terminals are not fully inserted, the terminal latches are deflected and the terminal position member cannot be inserted into the connector housing. The preferred embodiment of this connector can include up to one hundred and four terminals and a large mating force therefore results when the plug connector is mated to the pin header. The plug connector therefore includes a bolt that is used to mate the plug connector to the pin header.

SUMMARY OF THE INVENTION

Although this prior art connector provides an effective means for terminating a large number of wires to a motor vehicle electronic module, these wires must still be terminated in a single electrical connector. Assembly of the wiring harness would be simplified if wires emanating from different parts of a motor vehicle could be terminated to separate electrical connectors. However, additional space would be required to mate multiple electrical connectors to a header or headers, especially if terminal position assurance members and force applying means, such as bolts, must be employed for multiple plug connectors. The instant invention provides a means for mating two plug connectors in a pin header that is not larger than a prior art pin header, and a means for maintaining adjacent contacts on substantially the same centerline spacings of approximately 3.4 mm. The number wires that can be terminated in the same space is not significantly reduced. Furthermore, the components of this electrical connector assembly can still be economically fabricated, and molded. Proven sealing components and the same force applying bolt assembly can still be employed.

An electrical connector according to one aspect of this invention includes a housing with a plurality of terminals positioned in terminal cavities located in at least one row in the housing. Each terminal cavity includes a terminal latch. The electrical connector also includes a terminal position assurance member supporting the terminal latches when terminals are fully inserted in corresponding terminal cavities. The terminal position assurance member includes a first cantilevered member extending parallel to the row of terminal cavities and a second cantilevered member extending transverse to the first cantilevered member. The first cantilevered member engages only a portion of the terminal latches in the row and the second cantilevered member engages at least one other of the terminal latches.

This electrical connector includes molded terminal latches extending from the housing into each cavity. Each terminal latch is deflectable to permit insertion of the respective terminal into the respective cavity. The terminal latches in a cavity on one end of a row are deflectable in a direction perpendicular to the direction in which other terminal latches in the same row are deflected.

According to another aspect of this invention the electrical connector assembly also includes a header with a plurality of pins located in two mating pockets. Two plug connectors are matable with the header in the two mating pockets. Each plug connector includes a connector housing and a plurality of terminals located in terminal cavities. Two bolts extend through the center of each plug connector housing and engage the header to secure the respective plug connector to the header. An auxiliary locking member, or terminal position assurance member, is mounted on a mating face of each respective plug connector housing. The auxiliary locking member includes rearwardly extending arms partially overlapping the respective bolts above and below the respective bolts. These arms secure the terminals in terminal cavities to increase the number of terminals and pins in the header and the plug connectors.

BRIEF DESCRIPTION OF THE DRAWINGS

FIG. 3 is a front view of the pin header shown in FIG. 2 showing the location of four rows of staggered pins in which inner pins partially overlap the area in which a mounting bolt is located.

FIG. 9 is a partial section view of a terminal located in one of the terminal cavities with a horizontal terminal position assurance plate supporting the terminal latch.

DETAILED DESCRIPTION OF THE PREFERRED EMBODIMENT

Figure 1:
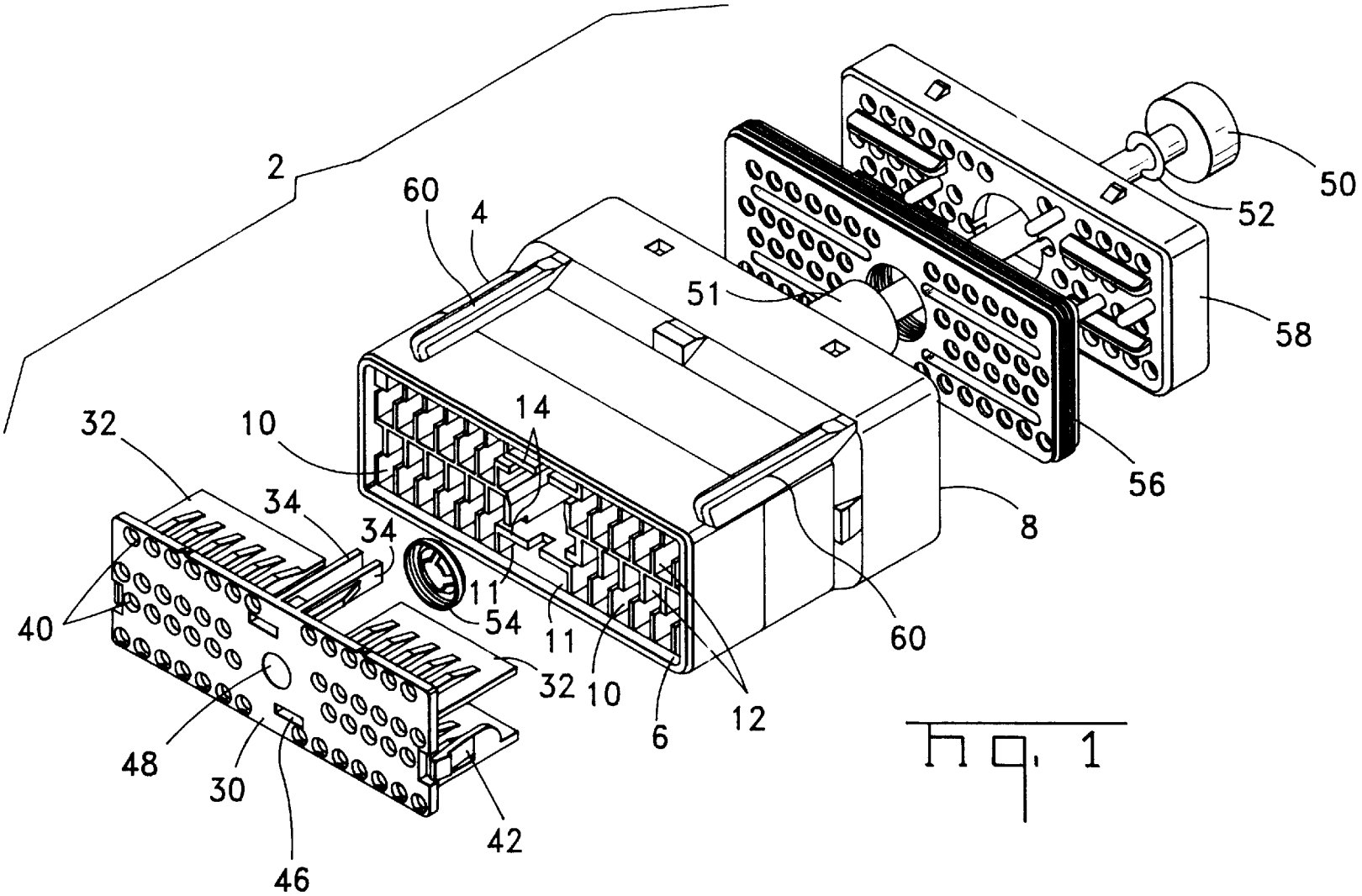
FIG. 1 is an exploded view of one plug connector that can be used with another similar plug connector in an assembly in which both plug connectors are mated with the same multi-pocket pin header.
Figure 2:
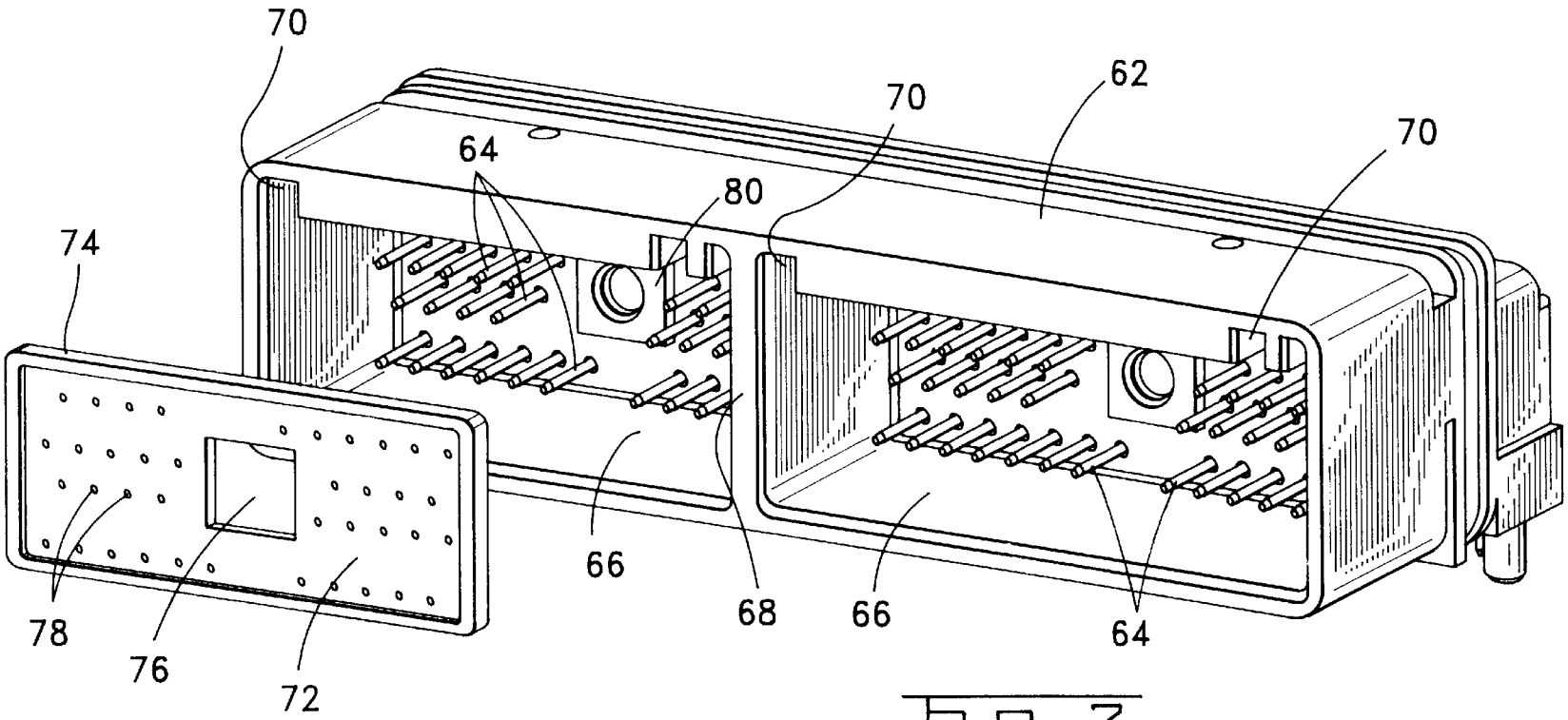
FIG. 2 is a view of a pin header having two pockets in which separate plug connectors of the type shown in FIG. 1 are mated. A gasket seal used in one pocket is also shown.
Figure 11:
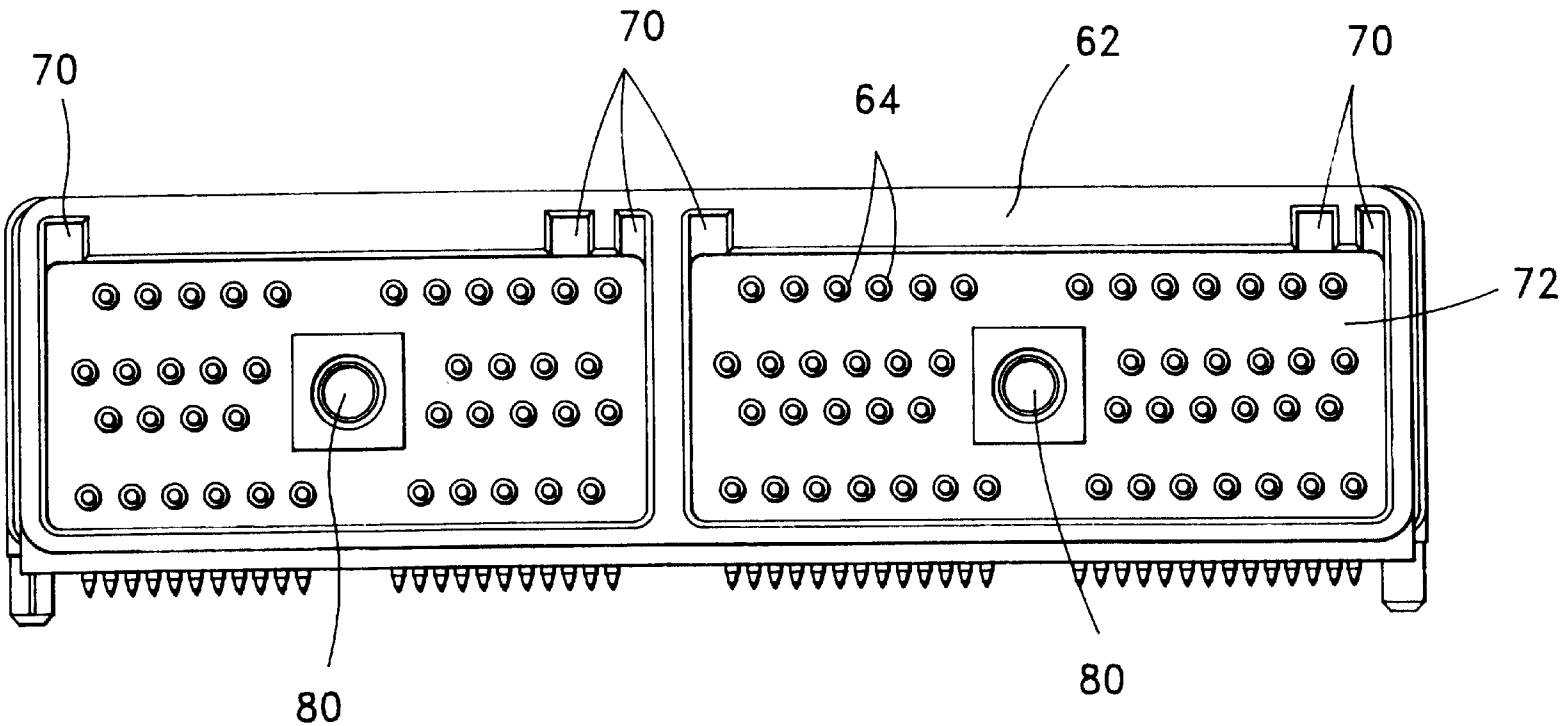

FIG. 1 shows a fifty position plug connector 2 that can be inserted in one of the pockets 66 of the pin header 62 shown in FIGS. 2 and 3. In the preferred embodiment of this invention a second plug connector having forty positions would be inserted into the other pocket. The forty position plug connector differs from the fifty position plug collector only in the number and location of the terminals 20 in the connector, but includes the same basic components as fifty position plug connector 2. The fifty position plug connector 2 is therefore representative of both plug connectors and the forty position plug connector is not separately shown.

Plug connector 2 includes a molded housing 4 having fifty terminal cavities 10, 11 extending between a mating face 6 and a rear face 8. The terminal cavities 10, 11 are positioned in four parallel rows and each row is interrupted in the middle to provide space for a securing member, such as a bolt 50. The majority of the terminal cavities 10 are formed by cavity walls 14 that separate adjacent cavities in each row. Four terminal cavities 11, located on the inner ends of the top and bottom terminal rows adjacent the unoccupied, unpopulated or interrupted center section are formed by cavity walls 14 that extend parallel to the terminal rows. The terminal cavities 10, 11 in adjacent rows are staggered and the inner cavities 11 in the top and bottom row partially overlap the space needed for a mounting bolt 50 and the tower 51 in which the bolt 50 is mounted.

Figures 4, 7, 10:
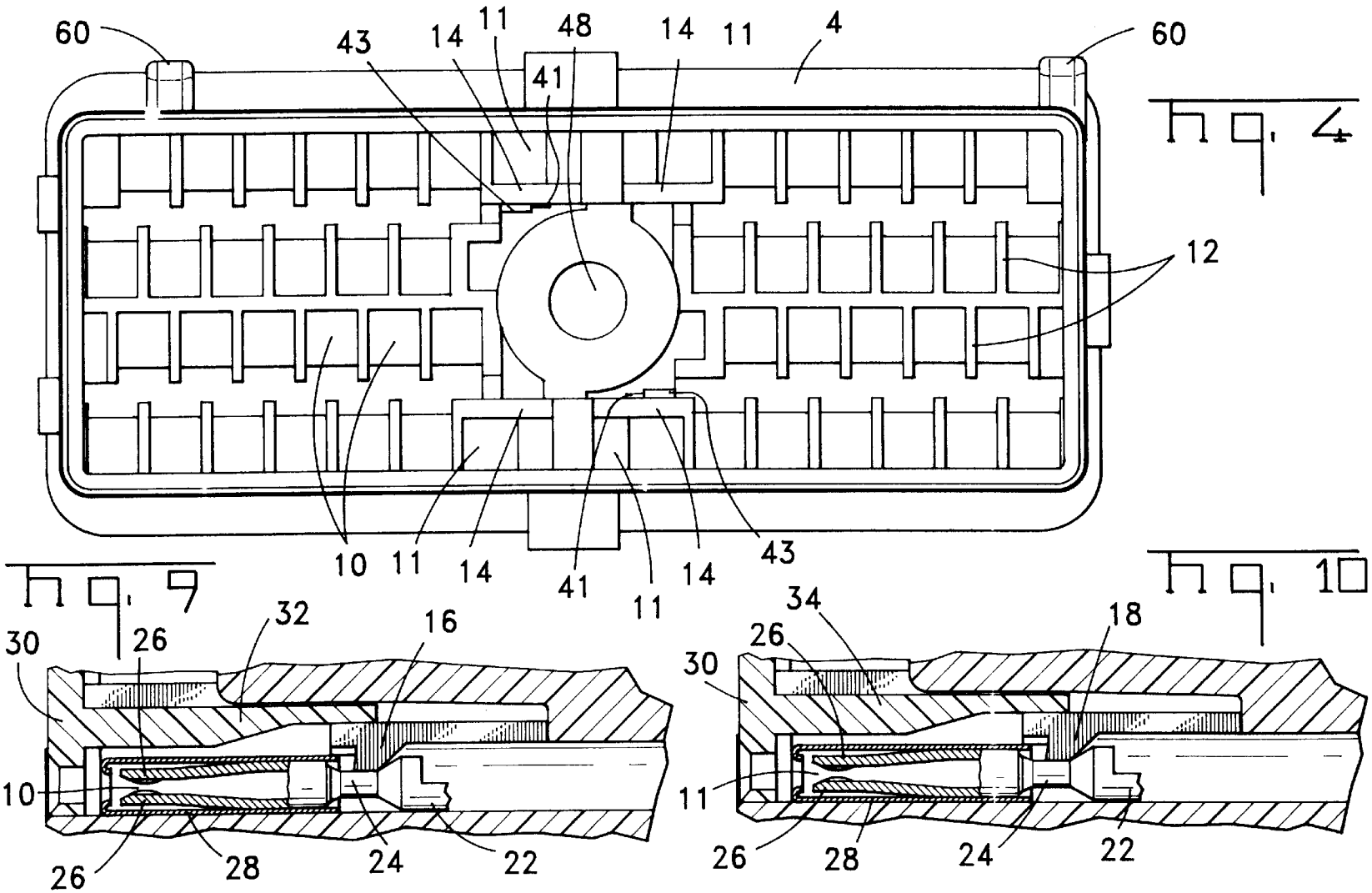
FIG. 4 is a front view of the plug connector housing of FIG. 1 showing the location of terminal cavities in four rows and showing a central opening for receiving a mounting bolt.
FIG. 7 is a view of the inside surface of the terminal position assurance member of FIGS. 5 and 6.
FIG. 10 is a partial section view of a terminal located in one of the terminal cavities located on the inner end of the top or bottom terminal row in which the terminal position assurance arm extends vertically.
Figure 5:
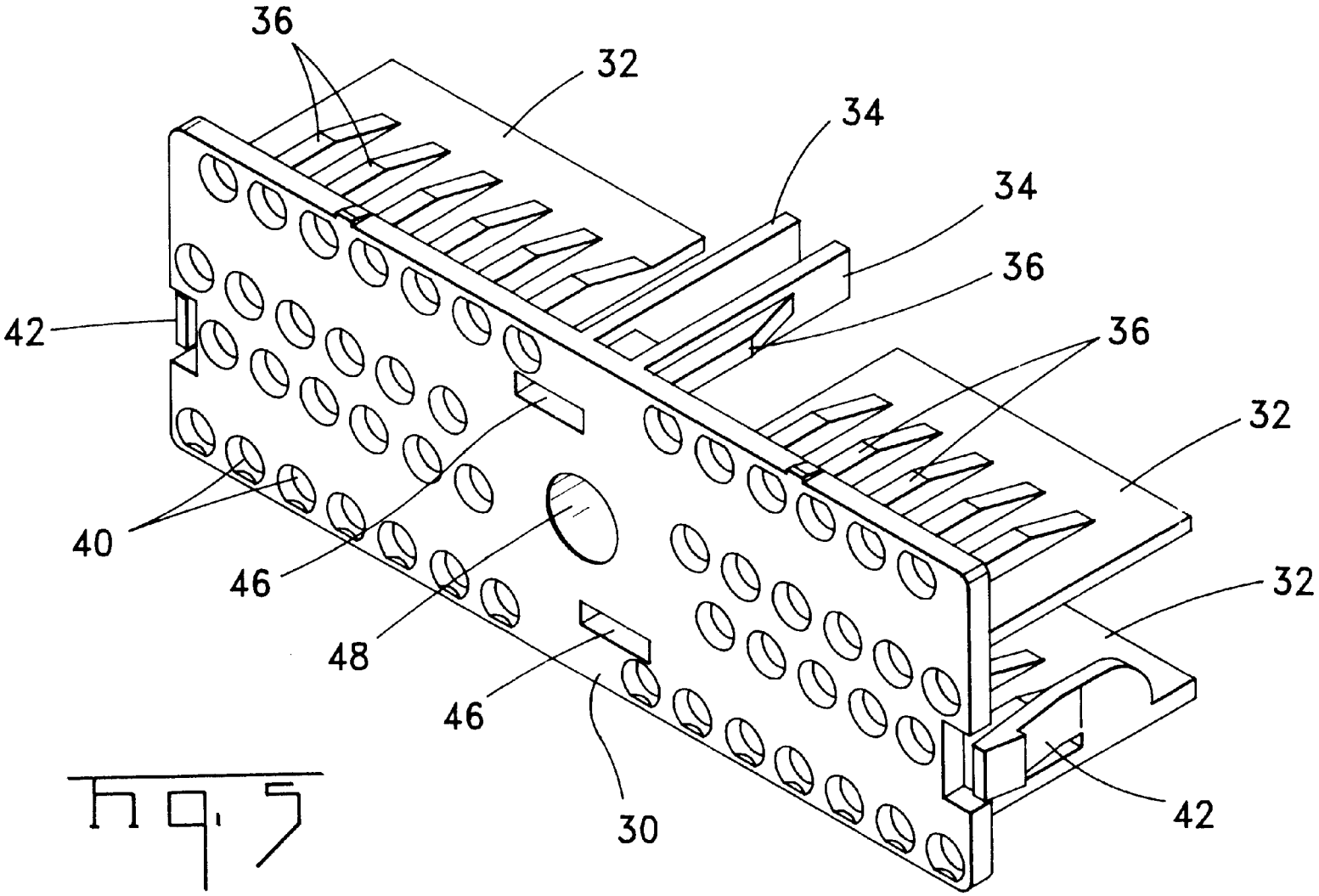
FIG. 5 is a perspective view of a terminal position assurance member that is mounted on the front of the plug connector of FIG. 1.
Figure 6:
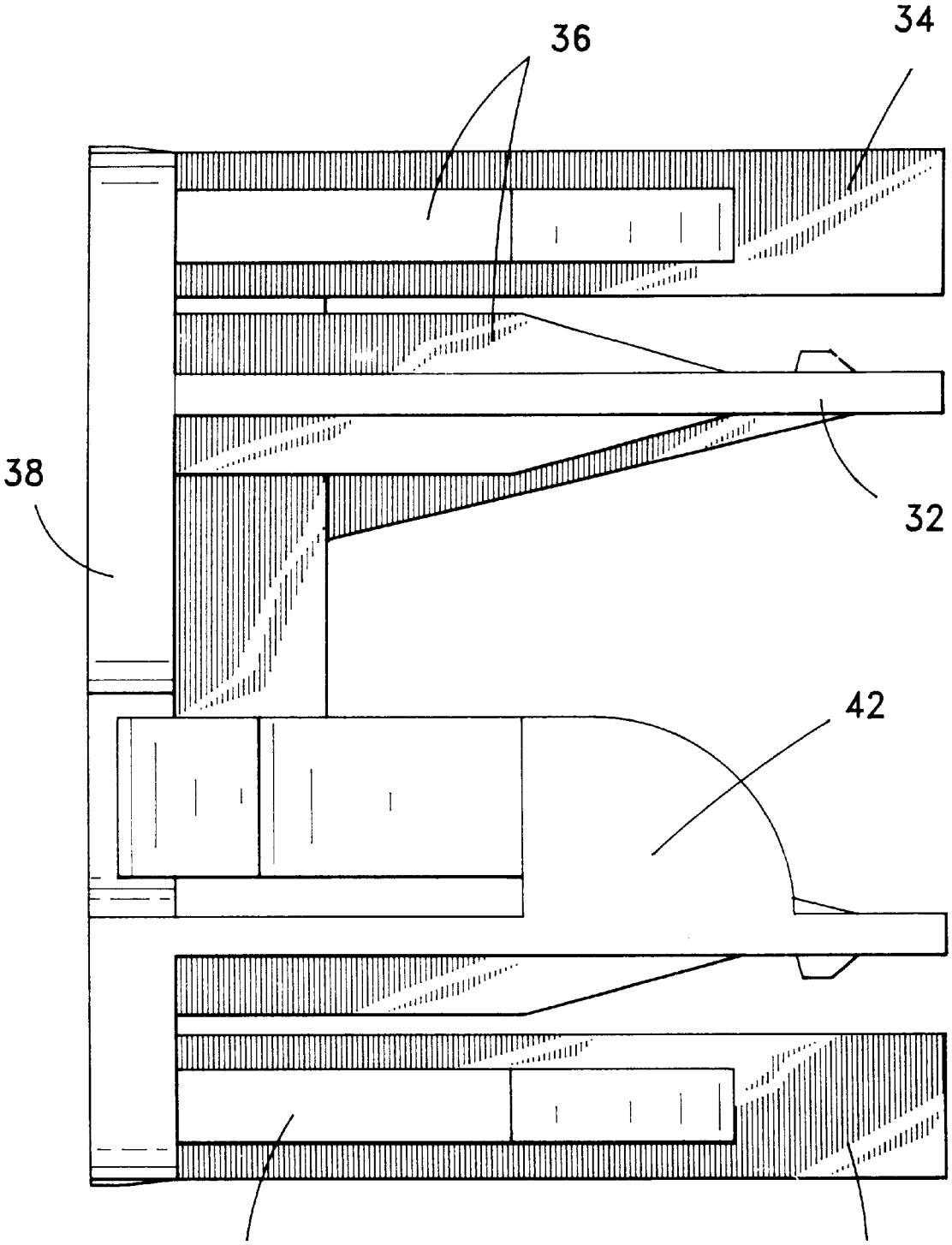
FIG. 6 is an end view of the terminal position assurance member of FIG. 5.
Figure 7:
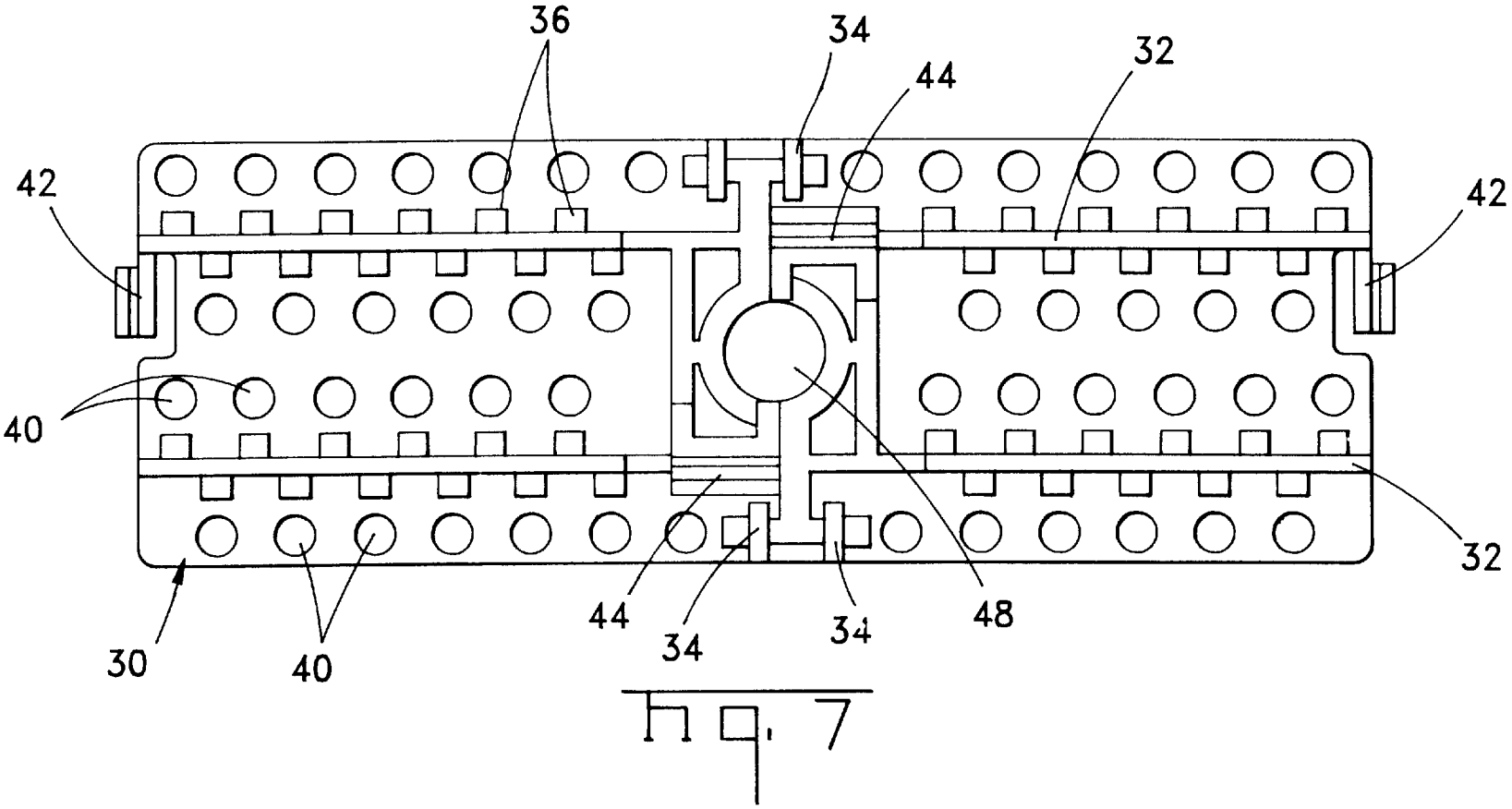

Terminals 20 are held in the terminal cavities 10, 11 by primary terminal latches 16 and 18 as shown in FIGS. 9 and 10. Latches 18 are located in the four inner cavities 11 defined by cavity walls 14 on the top and bottom rows. Latches 16 secure terminals in the other terminals cavities 10. Each of the terminal latches 16 and 18 comprise molded extensions of the housing 4 that normally extend into the corresponding terminal cavity 10, 11. These terminal latches 16, 18 are flexible and can be deflected when a terminal 20 is inserted into the housing cavity 10, 11 through the rear housing face 8. The latches 16 are deflected in a direction perpendicular to the corresponding terminal row. The latches 18 are however located on a vertical wall of the cavities 11, when viewed from the perspective of FIG. 4, and these four latches 18 will deflect in a direction parallel to the corresponding terminal row. In other words the latches 16 deflect in a direction that is perpendicular to the direction in which the latches 18 deflect.

The terminals 20 comprise cylindrical receptacle terminals that are crimped to a wire in a conventional manner. The wire crimp section, not shown, is located at the rear of the terminals adjoining cylindrical section 22. An annular recess 24 is located in front of this larger cylindrical section, and recess 24 forms a space in which the latching head of either terminal latch 16 or latch 18 can engage the terminal. Since the terminals 20 are cylindrical and since the annular recess 24 is uniform around the entire circumference of the terminal 20, the direction in which the latch extends is insignificant. In terminal cavities 10 the latch 16 will engage either the top or the bottom of the terminal recess 24. In terminal cavities 11, the latches 18 will engage the side of the annular recess 24. In either case the latches 16 or 18 will satisfactorily secure the terminals 20 in the housing 4.

Terminals 20 also have cantilevered mating beams 26 located at the front or mating end of the terminal 20 to engage the pins 64 when the plug connector 2 is mated to the header 62. A cylindrical sleeve 28 is secured to the exterior of the mating end of the terminals 20, and the sleeve 28, which is open on the front and back, extends completely around the beams 26. The outer diameter of the sleeve 28 is larger than that of the annular recess 24, and it is this sleeve 28 that engages the terminal latches 16 and 18 and outwardly deflects them during insertion of the terminals 20 into cavities 10 and 11. When the terminals 20 are fully inserted into the respective cavities 10 and 11, the cylindrical sleeve 28 clears the head of the latches 16, 18 and the head of the latches 16, 18 is then aligned with the respective recess 24 so that the latches 16, 18 can return to their normal latching position shown in FIGS. 9 and 10.

Once the terminals 20 have been properly positioned in their respective terminal cavities 10, 11, an auxiliary locking member, or reinforcing member or terminal position assurance member 30 can be inserted into the housing 4 through the mating face 6. Terminal position assurance is provided when an auxiliary member, such as front mounted terminal position assurance member 30, supports or backs up the primary latching members 16, 18 but can only be inserted into the supporting position shown in FIGS. 9 and 10 when the terminals 20 are fully inserted or properly positioned in the respective housing terminal cavity 10, 11.

Terminal position assurance member 30 includes four first cantilevered members 32 and four second cantilevered members 34 that support the primary latches 16, 18 in the four terminal rows of plug connector 2. The first cantilevered members or plates 32 extend parallel to the terminal rows while the second cantilevered members or arms 34 extend perpendicular to the terminal rows. Arms 34 are located at the inner ends of each of the plates 32 and are opposed to the plates 32 and are offset from the plane of the plates 32. The cantilevered plates 32 and cantilevered arms extend from a front cover panel 38. Terminal position assurance member 30 comprises a one piece molded member with the cantilevered members 32 and 34 integrally joined to the front panel 38. The distal ends of plates 32 and arms 34 are free. Ridges 36 are molded on the plates 32 and arms 34 and extend from the front panel 38 towards the rear distal ends of plates 32 and arms 34. These ridges 36 do not extend to the distal end of the cantilevered members and as shown in FIGS. 9 and 10 the latches 16 and 18 are supported by the portion of the cantilevered members between the ends of the ridges 36 and the distal ends of the cantilevered members. The ridges 36, however, partially close one side of the terminal cavities when the terminal position assurance member is fully inserted.

In the embodiment of the terminal position assurance member 30 depicted herein, the front panel 38 has fifty holes 40 dimensioned to receive the header pins 64 when the plug connector 2 mates with the header 62. A central bolt opening 48 is also located between the cantilevered plates 32. The cantilevered arms 34 are located above and below this central opening 48 and partially overlap this opening. Opening 48 is dimensioned to permit the mounting bolt 50 to pass through the terminal position assurance member to engage the header 62 for mating the plug connector 2 to the header 62.

Figure 8:
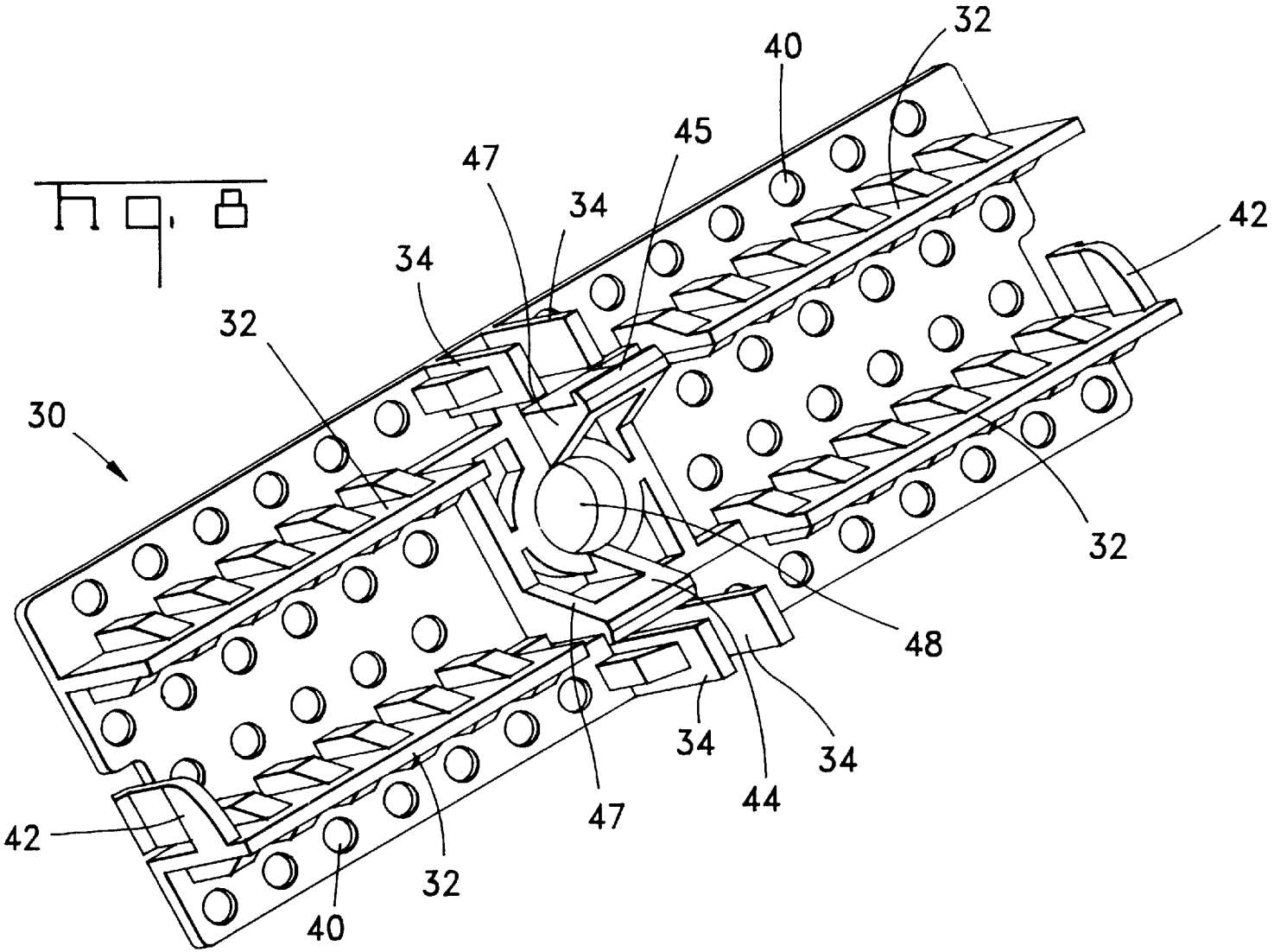
FIG. 8 is a interior perspective view of the terminal position assurance member shown in FIG. 7.

Two flexible end snap latches 42 are molded on opposite ends of the terminal position assurance member 30 and two offset center latches 44, as seen in FIGS. 7 and 8 are located in the center of the terminal position assurance member 30. Each center latch 44 is U-shaped and includes two legs 47 that are joined at their distal ends by a center snap latching section 45 that includes a tapered surface for deflecting the center latch 44 and a perpendicular section for securing the center latch 44 when fully inserted. Center latches 44 also partially overlap the bolt mounting hole 48. The center latches 44 are mutually offset on the top and bottom of the bolt mounting hole 48, and inner cantilevered arms 34 are located above and below the two center latches 44. Two molding slots 46 extend through the front panel 38 so that the latching head on center latches 44 can be molded in a straight pull molding operation without the need of side pulls. The four latches 44 engage protruding bumps or surfaces 41 and 43 on the housing 4 first to retain the terminal position assurance member 30 in an extended position and then to secure the terminal position assurance member 30 to the housing 4. In the extended position, which is not shown, the snap latch section 45 engages the rear of a first protruding surface or bump 41 on the housing 4. The snap latch section 45 is trapped between bump 41 and a second offset and larger bump 43. In this extended position, the cantilevered plates 32 and the cantilevered arms 34 are offset from the terminal latches 16 so that these latches 16 are free to deflect when terminals 20 are inserted. The end latches 42 also help retain the terminal position assurance member 30 in this extended position so that the housing subassembly can be shipped and there is not need to separately insert the terminal position assurance member 30 into the housing during the terminal insertion operation. After all terminals 20 have been properly inserted, the terminal position assurance member 30 can be fully inserted. The center latches 44 are deflected as the center snap latching section 45 rides over the larger retaining bump 43 and ultimately snaps back into position behind the rear bump 43 to retain the terminal position member 30 in its fully assembled position.

The terminal position assurance member 30 cannot be inserted into mating engagement with the housing 4 and the latches 42, 44 cannot be engaged unless the plates 32 can enter the opening formed between terminal latches 16 between terminal rows and unless the arms 34 can enter spaces beside terminal latches 18. Only if all of the terminals 20 are fully inserted, and the latches 16 and 18 are properly engaged in recesses 24 as shown in FIGS. 9 and 10, can the terminal position assurance member 30 be properly inserted. However, once the terminal position assurance member 30 is fully inserted, the plates 32 and the arms 34 support respective terminal latches 16 and 18 and prevent dislodgment of the terminals 20 from the primary latches 16 and 18.

As previously mentioned, the plug connector 2 is mated to the header 62 by a bolt 50. The bolt 50 is mounted in the plug housing 4 by a snap ring 54 that is inserted through the front housing face 6. Bolt 50 is mounted in a tower 51 extending from the rear of the housing 4 and an O-ring 52 maintains sealing integrity between the bolt 50 and the bolt tower 51. Bolt 50 also extends through a matt wire seal 56 and a seal retainer 58 that are attached to the rear of the housing 4. The seal retainer or cap 58 fits within a housing shroud on the rear of the connector so that caps 58 on adjacent plug connectors do not interfere and prevent two plug connectors from being mounted in the two pockets on the pin header 62. Keying ribs 60 on the exterior of the plug housing 4 engage keying slots 70 on the header 62 so that rotation of the bolt 50, which is received within a nut 80 in the header 62 causes the plug connector 2 to be drawn into the header 62 and causes the terminals 20 to mate with the header pins 64.

The header 62 is intended to be mounted on an electronic module and the header pins 62 are bent at right angles on the rear of the header 62 so that the header can be soldered to a printed circuit board in the module in a conventional manner. As shown in FIGS. 2 and 3, two pockets 66 are formed on the front or mating side of header 62. In the preferred embodiment the pocket 66 on the right in FIGS. 2 and 3 includes fifty pins and is intended to receive the fifty position plug connector 2 shown in FIG. 1. The left pocket 66 in FIGS. 2 and 3 contains forty pins and a forty pin plug connector of similar construction would be inserted into this pocket. Pockets 66 are separated by a central wall 68 and keying slots 70 are located along the top of each pocket 66. The pins 64 are staggered in four rows and are positioned to mate with the terminals 20 in the plug connectors. The pins on the innermost ends that will mate with the terminals 20 in cavities 11 on the inner ends of the plug connector terminal rows are spaced from adjacent pins in the same row by the same distance so that no unusual pin configuration results at the distal ends of the pins that are to be soldered into a printed circuit board.

The interface between the plug connector 50 and header 62 is sealed by a seal, such as gasket seal 72. Although gasket seal 72 is a forty position seal, the seal used in the right pocket that engages plug connector 50 is of basically the same construction. Gasket seal 72 is formed of a conventional elastomeric material and is mounted in the corresponding pocket 66 at the base of the pocket. Seal 72 includes holes 78 through which pins 62 extend and a seal rim 74 extending around the periphery of the gasket seal 72. The plug connector mating face will engage this seal rim 74 to establish a seal around the inner periphery of the pocket 66. Therefore it will not be necessary to compress the entire seal and the force exerted by the compressed seal on the header housing will not be sufficient to cause cracks in the header. The seal 72 also includes an opening 76 that permits the bolt 50 to engage the nut 80 located mounted on the base of the respective pocket 66.

The preferred embodiment depicted herein is representative of equivalent embodiments that are defined by the following claims.

We claim:

1. An electrical connector comprising a housing with a plurality of terminals positioned in terminal cavities located in at least one row in the housing, each terminal cavity including a terminal latch, the electrical connector further comprising a terminal position assurance member supporting the terminal latches when terminals are fully inserted in corresponding terminal cavities, the electrical connector be characterized in that:

the terminal position assurance member includes a first cantilevered member extending parallel to the row of terminal cavities and a second cantilevered member extending transverse to the first cantilevered member, the first cantilevered member engaging only a portion of the terminal latches in the row and the second cantilevered member engaging at least one other of the terminal latches, said first and second cantilevered members pivot about axes which are normal to one another.

2. The electrical connector of claim 1 wherein at least one of the terminal latches is deflectable transversely relative to other terminal latches when terminals are inserted into respective terminal cavities.

3. The electrical connector of claim 2 wherein the second cantilevered member engages the terminal latch deflectable transversely to other terminal latches engaged by the first cantilevered member when the terminal position assurance member is fully inserted into the housing.

4. The electrical connector of claim 3 wherein the second cantilevered member engages a terminal latch located at the end of the row of terminals.

5. The electrical connector of claim 1 wherein the first and second cantilevered members extend separately from a front panel on the terminal position assurance member.

6. The electrical connector of claim 1 wherein the first and second cantilevered members include ridges, portions of the cantilevered members extending beyond the ridges engaging the terminal latches when the terminal position assurance member is fully inserted into the housing.

7. The electrical connector of claim 1 wherein terminals are positioned in parallel rows of terminal cavities.

8. The electrical connector of claim 7 wherein a central opening is formed between cavities in parallel rows of terminal cavities, with the terminal latches engaged by the second cantilevered member on the terminal position assurance member being located adjacent the central opening.

9. The electrical connector of claim 8 wherein the terminal position assurance member is insertable through a mating face of the connector housing and the central opening provides clearance for a securing member for securing the electrical connector to mating electrical connector.

10. The electrical connector of claim 1 wherein the first cantilevered member comprises a plate including means for engaging a plurality of terminal latches and the second cantilevered member comprises an arm for engaging a single terminal latch.

11. An electrical connector comprising a housing with a plurality of terminals located in terminal cavities in at least one row with a molded terminal latch extending from the housing into each cavity to secure the respective terminal in the respective cavity, each terminal latch being deflectable to permit insertion of the respective terminal into the respective cavity, the terminal latches in a cavity on one end of the row being deflectable in a direction perpendicular to the direction in which other terminal latches in the same row are deflectable.

12. The electrical connector of claim 11 wherein a bolt for securing the electrical connector to a mating connector is located adjacent terminal latches on the inner ends of the row.

13. The electrical connector of claim 12 wherein the terminals are located in multiple parallel rows, latches in cavities above and below the bolt being deflectable in a direction perpendicular to the direction in which other terminal latches in the same row are deflectable.

14. The electrical connector of claim 11 wherein the terminals are cylindrical so that a respective terminal latch secures the terminal in the housing regardless of the angular position in which the terminal latch engages the terminal.

15. The electrical connector of claim 11 wherein a terminal position assurance member in mounted on the housing, the terminal position assurance member including mutually perpendicular surfaces for engaging latches deflectable in perpendicular directions.

16. An electrical connector assembly comprising:

a header including a plurality of pins located in two mating pockets;

two plug connectors matable with the header in the two mating pockets, each plug connector including a connector housing and a plurality of terminals located in terminal cavities;

two bolts, each bolt extending through the center of each plug connector housing and engaging the header to secure the respective plug connector to the header, and an auxiliary locking member mounted on a mating face of each respective connector housing; the auxiliary locking member including rearwardly extending arms overlapping from the center to an edge of the respective bolt, but offset from each other above and below the respective bolts and comprising means for securing the terminals in terminal cavities to increase the number of terminals and pins in the header and the plug connectors.

17. The electrical connector assembly of claim 16 wherein the auxiliary locking member comprises a terminal position assurance member engaging terminal latches extending from the housing into respective terminal cavities, the terminal position assurance member being fully insertable into the respective housing when terminals are fully inserted into respective terminal cavities.

18. The electrical connector assembly of claim 16 wherein the auxiliary locking member includes rearwardly extending plates insertable between parallel rows of terminals, the rearwardly extending arms extending transversely to the rearwardly extending plates.

19. The electrical connector assembly of claim 18 wherein the arms and the plates comprise cantilevered members extending from a front panel of the auxiliary locking member.

20. The electrical connector assembly of claim 19 wherein center latches are located above and below the bolts with at least one cantilevered arm being located between a center latch and a side edge of the auxiliary locking member.

* * * * *